US008292201B2

(12) United States Patent
Patterson et al.

(10) Patent No.: US 8,292,201 B2
(45) Date of Patent: Oct. 23, 2012

(54) SHOWER SADDLE

(75) Inventors: Charles A. Patterson, Durango, CO (US); Julian C. Giggs, Hillsdale, MI (US); Michael Miller, Portage, MI (US); Victor Hoernig, Lowell, IN (US)

(73) Assignee: Alsons Corporation, Hillsdale, MI (US)

( * ) Notice: Subject to any disclaimer, the term of this patent is extended or adjusted under 35 U.S.C. 154(b) by 46 days.

(21) Appl. No.: 12/560,791

(22) Filed: Sep. 16, 2009

(65) Prior Publication Data

US 2011/0062255 A1 Mar. 17, 2011

(51) Int. Cl.
*B05B 15/08* (2006.01)
*B05B 15/06* (2006.01)
*A47K 3/20* (2006.01)

(52) U.S. Cl. ..... 239/587.4; 239/283; 4/570; 4/615

(58) Field of Classification Search ..... 239/282, 239/283, 525, 587.1, 587.3, 587.4; 4/567, 4/568, 570, 605, 615
See application file for complete search history.

(56) References Cited

U.S. PATENT DOCUMENTS

| | | | | |
|---|---|---|---|---|
| 2,971,701 | A | 2/1961 | Shames et al. | |
| 3,865,310 | A | 2/1975 | Elkins et al. | |
| 3,979,096 | A | 9/1976 | Zieger | |
| 4,091,998 | A | 5/1978 | Peterson | |
| D267,582 | S | 1/1983 | Mackay et al. | |
| 4,674,687 | A * | 6/1987 | Smith et al. | 239/447 |
| 4,719,654 | A | 1/1988 | Blessing | |
| 4,964,573 | A | 10/1990 | Lipski | |
| 5,070,552 | A | 12/1991 | Gentry et al. | |
| D323,830 | S | 2/1992 | Sergi | |
| 5,230,106 | A | 7/1993 | Henkin et al. | |
| D341,191 | S | 11/1993 | Klose | |
| 6,450,425 | B1 | 9/2002 | Chen | |
| 6,502,796 | B1 | 1/2003 | Wales | |
| 6,611,971 | B1 | 9/2003 | Antoniello et al. | |
| 6,757,920 | B2 | 7/2004 | Antoniello et al. | |
| 7,124,453 | B2 | 10/2006 | Sun | |
| 7,299,510 | B2 | 11/2007 | Tsai | |
| 2004/0199993 | A1 | 10/2004 | Bui | |
| 2007/0067902 | A1 * | 3/2007 | Miller et al. | 4/567 |
| 2007/0272770 | A1 | 11/2007 | Leber et al. | |
| 2008/0022450 | A1 | 1/2008 | Tsai | |
| 2008/0121293 | A1 * | 5/2008 | Leber et al. | 137/597 |
| 2008/0169362 | A1 | 7/2008 | Kwan et al. | |
| 2008/0272203 | A1 | 11/2008 | Leber | |
| 2008/0272591 | A1 | 11/2008 | Leber | |

* cited by examiner

*Primary Examiner* — Darren W Gorman
(74) *Attorney, Agent, or Firm* — Carlson, Gaskey & Olds PC

(57) ABSTRACT

The present invention is an adjustable shower saddle that connects a water supply to a shower. The saddle has: an anchor for attaching to the water supply, the anchor having an inner contour for attaching to the water supply and an outer contour that corresponds to a multi-dimensional range of motion that may be taken by the saddle, and a conduit for conducting fluid; a bracket that has an outlet, a second conduit attaching to the outlet and, an interior surface conforming to the shape of the outer contour of the anchor; and, a lock member having a third conduit for conducting fluid from the first conduit to the second conduit, wherein the lock member attaches the bracket to the anchor.

19 Claims, 1 Drawing Sheet

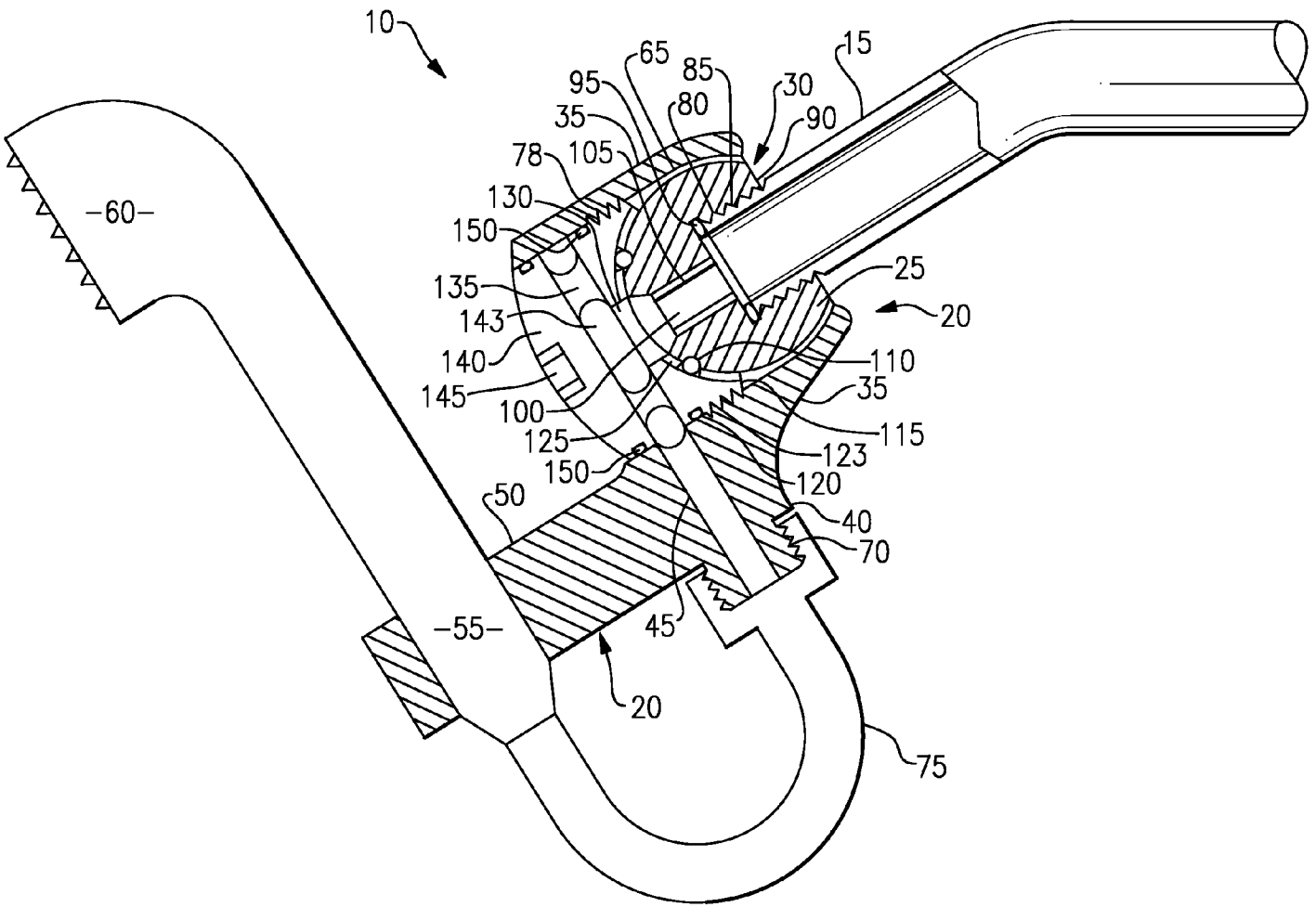
10
15
20
25
30
35
40
45
50
55
60
65
70
75
78
80
85
90
95
100
105
110
115
120
123
125
130
135
140
143
145
150
150
20
35

SHOWER SADDLE

BACKGROUND OF THE INVENTION

Modern showers frequently are a combination fixed shower and hand shower. A hand shower is removably attached to a bracket that attaches to a shower stub out. In a fixed mode, the hand shower is placed in the bracket and a user moves his body under the spray as desired. In a movable mode, the user removes the hand shower from the bracket and directs the spray of the removed hand shower by manipulating the hand shower. Showers in the fixed mode are difficult to adjust for those who need or want to use the shower in the fixed mode.

Some combination showers use a bracket that rotates about a fixed ball to allow a user the flexibility to adjust the shower head if being used in the fixed mode.

SUMMARY OF THE PRESENT INVENTION

The present invention is an adjustable shower saddle that connects a water supply to a shower. The saddle has: an anchor for attaching to the water supply, the anchor having an inner contour for attaching to the water supply and an outer contour that corresponds to a multi-dimensional range of motion that may be taken by the saddle, and a conduit for conducting fluid; a bracket that has an outlet, a second conduit attaching to the outlet and, an interior surface conforming to the shape of said outer contour of said anchor; and, a lock member having a third conduit for conducting fluid from said first conduit to said second conduit, wherein the lock member attaches the bracket to the anchor.

According to an embodiment of the invention, the bracket also has a holder for holding a hand shower, the outlet then attaching to a hose for the hand shower.

According to an embodiment of the invention, the lock member attaches to a front of the bracket so it is easily accessed by a user.

Other objects, features and advantages of the invention will be apparent from the following detailed description taken in connection with the accompanying drawings.

BRIEF DESCRIPTION OF THE DRAWING

The present invention will be more fully understood by reference to the following detailed description of a preferred embodiment when read in conjunction with the accompanying drawing, in which like reference characters refer to like parts throughout the views and in which:

FIG. 1 is a cross-sectional view of a shower saddle incorporating the present invention.

DETAILED DESCRIPTION OF THE PREFERRED EMBODIMENT OF THE PRESENT INVENTION

Referring generally to FIG. 1, there is shown a saddle 10 that attaches to a stub-out 15. The saddle is comprised of a bracket 20, a ball 25 that anchors (e.g., an anchor) the bracket thereto and a lock nut 30.

The bracket 20 is comprised of a socket 35, a hose outlet 40, a waterway or second conduit 45, an arm 50, and a channel 55 for holding shower head 60. The socket 35 has an inner contour 65. The hose outlet has an outer threaded portion 70 for attaching a shower hose 75 thereto. The bracket also has interior threads 78 that allow the lock nut 30 to be attached to the bracket as will be discussed hereinbelow.

The ball 25 has a first bore or first conduit 80 having a threaded portion 85 for mating with a threaded portion 90 of the stub out 15. The first conduit 80 extends downstream of the stub out 15. A flat o-ring 95 seals a connection between the ball and the stub out. The ball has a second bore 100 that is shaped to receive a tool (not shown), such as a Torx® wrench, to allow a user to turn and tighten the ball onto the stub out 15. The first bore 80 is in fluid communication with the second bore 100. The ball has a circular indentation 110 for receiving o-ring 115.

The lock nut 30 has a body portion 120 having a set of external threads 123, an arcuate portion 125 for cooperating with the ball 25 and the o-ring 115 and a third bore or third conduit 130, which is upstream of the second conduit and downstream of the first conduit 80 in fluid communication with the second bore 100 of the ball. The body portion has a plurality of posts 135 that attach to cap 140. By connecting the cap and the body portion with posts, an open area 143 is created that is in fluid communication with the second bore 105 100 and the waterway 45.

The cap 140 has an indentation 145 that that is shaped to receive a tool, such as a Torx® wrench, to allow a user to turn and tighten the external threads 123 into the interior threads 78 of the bracket.

A pair of o-rings 150 create a fluid-tight seal between the cap and the bracket to minimize fluid loss from the open area 143 as fluid flows through the first bore 80, the second bore 100 to the open area.

To install a shower saddle, a user slides the socket 35 of the bracket 20 over the stub-out 15. The user then places the o-ring in the first bore 80 and aligns its threads 85 with the threads of the stub-out. The user then places a tool (not shown) in the second bore 100 to torque the ball onto the stub-out 15. The bracket is then pulled down so that the ball is set in the socket. O-rings are then put in place and lock nut external threads are then screwed into the internal threads of the bracket by placing the tool in indentation 145 of the cap and twisting. By screwing down the cap, the open area of the lock nut is placed in fluid communication with the waterway 45.

The interior surfaces of the socket allow the bracket to rotate about the ball in several dimensions to allow a user to set the bracket in an ideal location for a positive shower experience. By placing the lock nut at the front of the saddle facing the shower head, a user may easily access the lock nut, which is important to provide the right amount of tension in rotating the bracket to balance ease of use while providing stable placement of the shower head and to provide access to the shower saddle should maintenance be required.

The foregoing detailed description has been given for clearness of understanding only and no unnecessary limitations should be understood therefrom as some modifications will be obvious to those skilled in the art. One of ordinary skill in the art will recognize that in accordance with the teachings of this invention, the spray from one or more apertures may create an effective barrier to effluent escape. Though the present system is shown in use with a commercial-type flush mechanism, one of ordinary skill in the art recognizes that other applications for the invention provided herein are readily available.

What it claimed is:

1. An adjustable shower saddle attaching to a water supply and to a shower head, said saddle comprising:

an anchor for attaching to the water supply, said anchor having:

an inner contour for attaching to the water supply;

an outer contour;

a first conduit for conducting water, said first conduit extending through said anchor and beyond said water supply;

a bracket for holding said shower head, said bracket having:

an outlet communicating with said shower head;

a second conduit passing therethrough and attaching to said outlet;

an interior surface conforming to the shape of said outer contour of said anchor and in contact therewith such that said bracket rotates about said outer contour of said anchor; and, a lock member attaching said bracket to said anchor and having a third conduit passing therethrough, said third conduit disposed between said anchor and said bracket and downstream of said first conduit and upstream of said second conduit for conducting fluid from said first conduit to said second conduit, said lock member having an arcuate portion for cooperating with said outer contour and wherein said lock member forms an exterior surface of said saddle.

2. The saddle of claim 1 wherein said anchor further comprises:

a shape conforming to a shape of a tool for attaching said inner contour of said anchor to said water supply wherein said shape is non-circular.

3. The saddle of claim 1 wherein said lock member has a shape conforming to a shape of a tool for attaching said lock member to said bracket.

4. The saddle of claim 1 further comprising a holder for said shower head disposed on said bracket.

5. The saddle of claim 4 wherein said holder is disposed in said bracket.

6. An adjustable shower saddle, said saddle comprising:

an anchor, said anchor having:

an outer contour, said outer contour corresponding to a range of motion that may be taken by said saddle, and a first conduit for receiving fluid from a water supply and conducting the fluid passing through said anchor, said first conduit extending through said anchor and beyond said water supply, a bracket for holding a shower head and having:

an outlet, a second conduit passing therethrough and attaching to said outlet, an interior surface conforming to and contacting the shape of said outer contour of said anchor; and a lock member having a third conduit passing therethrough for conducting fluid from said first conduit to said second conduit, wherein said lock member attaches said bracket to said anchor, said lock member forming an outer surface of said saddle, said lock member having an arcuate portion for cooperating with said outer contour.

7. The saddle of claim 6 wherein said anchor further comprises:

an interior shape conforming to a shape of a tool for attaching said inner contour of said anchor to said water supply.

8. The saddle of claim 6 wherein said lock member is disposed at a front of said bracket facing said shower head.

9. The saddle of claim 6 wherein said lock member has a shape conforming to a shape of a tool for attaching said lock member to said bracket.

10. The saddle of claim 6 further comprising a holder for holding said shower head.

11. The saddle of claim 10 wherein said holder is disposed in said bracket.

12. An adjustable shower saddle attaching to a water supply and to a shower head, said saddle comprising:

a ball, said ball having:

an inner contour for attaching to the water supply, an outer contour, and a first conduit passing therethrough said first conduit extending through said anchor and beyond said water supply;

a bracket having:

an outlet communicating with said shower head, a second conduit attaching to said outlet, an interior surface conforming to the shape of said outer contour of said ball; and, a lock member having a third conduit passing therethrough disposed between said ball and said bracket and downstream of said first conduit and upstream of said second conduit for conducting fluid from said first conduit to said second conduit, wherein said lock member attaches said bracket to said ball, said lock member having an arcuate portion for cooperating with said outer contour and wherein said lock member forms an exterior surface of said saddle.

13. The saddle of claim 12 wherein said ball further comprises:

an interior shape conforming to a said shape of a tool for attaching said inner contour of said ball to said water supply.

14. The saddle of claim 12 wherein said lock member is disposed at a front of said bracket facing said shower head.

15. The saddle of claim 12 wherein said lock member has a shape conforming to a shape of a tool for attaching said lock member to said bracket.

16. The saddle of claim 12 further comprising a holder for holding said shower head.

17. The saddle of claim 16 wherein said holder is disposed in said bracket.

18. The saddle of claim 12 wherein said lock member has a plurality of posts therein that create a chamber that transmits water therethrough.

19. An adjustable shower saddle, said saddle comprising:

an anchor, said anchor having:

an outer contour, said outer contour corresponding to a range of motion that may be taken by said saddle, and a first conduit for conducting fluid passing through said anchor, a bracket for holding a shower head and having:

an outlet, a second conduit passing therethrough and attaching to said outlet, an interior surface conforming to and contacting the shape of said outer contour of said anchor;

a lock member having a third conduit passing therethrough for conducting fluid from said first conduit to said second conduit, wherein said lock member attaches said bracket to said anchor, said lock member forming an outer surface of said saddle; and a holder for holding said shower head wherein said holder is disposed in said bracket.

* * * * *